United States Patent [19]

Grantham

[11] 4,327,510

[45] May 4, 1982

[54] MULTI-STATION LAUNDRY FEEDER

[76] Inventor: Frederick W. Grantham, 12055 Goshen Ave., Los Angeles, Calif. 90049

[21] Appl. No.: 172,934

[22] Filed: Jul. 28, 1980

[51] Int. Cl.[3] ..... D06F 67/02; D06F 67/04; A41H 33/00

[52] U.S. Cl. ..... 38/8; 38/143; 223/37

[58] Field of Search ..... 38/1 R, 7, 8–11, 38/143, 144; 223/37; 414/13; 271/8 R

[56] References Cited

U.S. PATENT DOCUMENTS

| | | | |
|---|---|---|---|
| 1,271,266 | 7/1918 | Bearmore | 38/143 |
| 1,406,823 | 2/1922 | Canfield | 414/13 X |
| 1,465,433 | 8/1923 | Hager | 38/143 X |
| 1,624,175 | 4/1927 | Nevills | 198/566 |
| 1,813,229 | 7/1931 | Constable | 209/705 |
| 2,226,659 | 12/1940 | Collins | 414/13 |
| 2,359,464 | 10/1944 | Carothers et al. | 198/346 |
| 2,645,364 | 7/1953 | Herrcke | 414/13 |
| 2,782,536 | 2/1957 | Kroener et al. | 38/11 |
| 3,019,583 | 2/1962 | Sylvester et al. | 53/377 |
| 3,327,942 | 6/1967 | Blume | 235/98 C |
| 3,342,386 | 9/1967 | Radermacher | 223/37 |
| 3,733,236 | 5/1973 | Young et al. | 156/360 |
| 3,756,588 | 9/1973 | Gerstenberger | 38/143 X |
| 3,806,007 | 4/1974 | Grantham | 223/37 |
| 4,035,983 | 7/1977 | Shanklin et al. | 53/28 |

*Primary Examiner*—Louis Rimrodt
*Attorney, Agent, or Firm*—Henry M. Bissell

[57] ABSTRACT

A multi-station laundry feeder including supply apparatus for a plurality of article conveyors, multiple stations at each conveyor, and an article transporting conveyor utilizable by the multiple stations for transversely placing articles on the transporting conveyor. The operators remove individual articles from the supply conveyor, drape them across the transporting conveyor, touching an adjustable bar which is positioned to automatically appropriately align the articles, and release them.

28 Claims, 8 Drawing Figures

MULTI-STATION LAUNDRY FEEDER

BACKGROUND OF THE INVENTION

1. Field of the Invention

The present invention relates to the field of commercial laundry equipment. More particularly, the present invention relates to a feed system for an ironer, folder or the like providing for multiple serially-located stations or positions, each of which is effective to provide garments to the ultimate ironer or folder.

2. Description of the Prior Art

In laundry-handling systems, the clothing, after drying, is often provided for folding, ironing and packaging in large bundles. Often, the ironing, folding and completing of the laundering steps are effected by an individual operator being supplied with garments and feeding them one-at-a-time to the appropriate ironing or folding equipment. This is a vast improvement over the older systems where each individual was provided with a table or automatic ironer, etc., to operate.

An exemplary feeding system for the folders is disclosed in Carothers et al. U.S. Pat. No. 2,359,464. The Carothers system uses two conveyors, the second being mounted inside the first. Clean diapers are placed on the lower inside of the first or larger conveyor and individually removed by various individuals who fold the diapers. Any overflow from the folding operation is returned by the second conveyor, and the top of the first conveyor is used to return unacceptable diapers to a rewashing basket. The system, however, requires individuals at plural stations to fold each diaper.

In another system, in U.S. Pat. No. 1,813,229 to Constable, dirty clothes are fed to individual compartments on a conveyor line and are sequentially sorted by color and character into bundles in individual units. The steps are performed by separate operators. The resulting small bundles are netted and marked for washing by two more operators. Thus, each position on the conveyor performs a different function. Also, Blume in U.S. Pat. No. 3,327,942 discloses a plural-station conveyor system for sorting clothes into light, medium and heavy-soiled groups. The conveyor provides the clothes to a plurality of operators who pick up individual articles and deposit them on three other conveyors which are designated for the light, medium and heavy-soil characteristics. Thus, in Blume, plural serially-arranged sorting stations, each performing the same function, are provided.

In the sorting art relating to other types of items, various transverse feed systems are known. For example, Young et al. in U.S. Pat. No. 3,733,236 disclose a single station reversible conveyor system which feeds meat to a scale and then transversely wraps, seals and marks the weighed item. Nevills in U.S. Pat. No. 1,624,175 utilizes a gear type of system to separate and individually feed pieces to a conveyor operating in a longitudinal direction.

Also, Sylvester et al. U.S. Pat. No. 3,019,583, and Shanklin et al. U.S. Pat. No. 4,035,983 both disclose single-item feed from a station to a transversely operated belt. Shanklin et al deal with a wrapping or sealing operation and do not disclose plural feed stations. Sylvester et al deal with a system for heat-sealing packages that are, at least, slightly irregular.

There is clearly a need in the art for a system to rapidly feed individual articles, such as towels, shirts, etc., to ironing and folding machines. A commercial ironer, in particular, is in need of any associated system which can increase the throughput of the ironer. The ironer is among the more expensive machines in a commercial laundry operation. A single ironer may be run with five lanes in parallel; that is, five girls feeding articles into the ironer at the inlet end and five separate folders associated with the ironer at the inlet or outlet. Such an arrangement not only allows a single machine to be used in conjunction with more feeders and more folders, but it also allows a mix in the types of items being processed through the folder at the same time. For example, napkins or other items requiring a french fold may be sent through a french fold lane, whereas other items requiring perhaps a quarter or half fold may be sent through another lane adapted to fold the items accordingly. In such an arrangement as now known in the art, the speed of processing items in ironing and folding the finished goods is essentially limited by the number of lanes which can be operated in parallel.

SUMMARY OF THE INVENTION

The present invention provides a system for feeding an ironer with a plurality of independently operable feeders, each of which may be utilized by plural operators. The use of independent feeders allows for maximizing the output of an ironer. Since plural stations are used, each line can be operated independently so that a break-down of one line will not terminate the whole ironing operation and different ironing operations can be effected at the same time. Thus, for instance, different towels having different folding and ironing requirements could be continuously ironed with one machine.

In operation, a conventional ironer is provided with a plurality of multiple station feeders. The feeders may be provided with articles to be fed by a common conveyor or separate conveyors, depending upon whether different articles are to be ironed or not. Each feeder is provided with at least two stations, either one or both of which may be used at any given time. A conveyor system is provided adjacent each station to supply, e.g., towels to each operator. The operator picks up an item to be ironed by its two adjacent corners and reaches over a feeder conveyor which may be a narrow belt, such as an ordinary V-belt, draping the article over the conveyor in the process. When the operator reaches a touch bar, which is selectively positioned, the operator releases the article and allows it to drape over the feeder conveyor. The same steps are taken by the second operator at the second station such that articles are placed on the one conveyor with increased speed and with appropriate spacing.

In an alternative embodiment, the articles are conveyed to an optional smoothing brush which is operatively interconnected with a switch and a sensor so that the item is smoothed and straightened and the brush is turned off just prior to reaching the end of the item. A nip roller is also provided to hold the item during the brushing operation.

If vertically aligned, the article is then passed between a pair of rollers, each fitted with a conveyor belt, and is reoriented to the horizontal by the belts which are twisted such that the inlet is vertically oriented and the outlet is horizontally oriented. The article is then ready for ironing. Depending upon the size and nature of the articles, a single narrow V-belt may be utilized to convey the item from the touch bar at the operator station to the reorienter, or a pair of spaced-apart narrow conveyor belts may be utilized. Also, a wider conveyor may be used. The reorienter may be used with a pair of narrow V-belts to facilitate flattening the article by a blade and spreader spaced between the feeder and the ironer.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
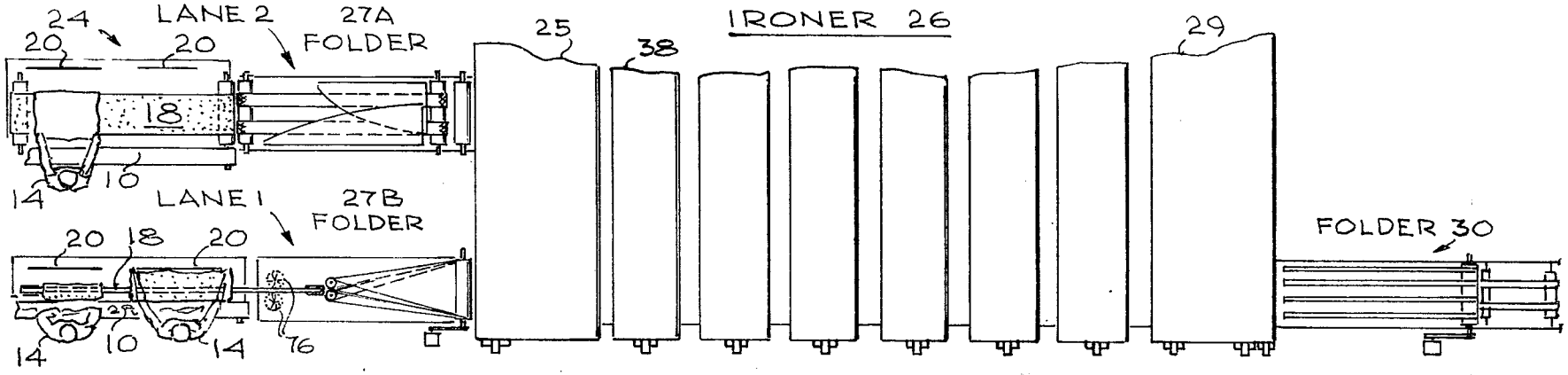
FIG. 1 is a simplified partial plan view of the overall multi-station feeder embodying the invention.

In FIG. 1, the basic structure of one particular arrangement of the present invention is shown schematically. In this figure, input or supply conveyors such as 10 are utilized to transport laundry items to each of the stations operated by the operators 14. The operators pick articles from supply conveyor 10 and drape them across their adjacent feeder conveyor 18. At each station, an operator 14 is provided with an adjustable touch bar 20.

In this manner, each operator 14, working at her own speed, places articles one at a time across a conveyor 18. In doing so, the operator picks up an article by its two end corners, reaches across the conveyor 18 to contact the touch bar 20 and immediately releases the article. The touch bar 20 is adjustable, and is set in position in accordance with the laundry articles being processed to be properly positioned on the conveyor 18.

The feeder conveyor 18 may be in the form of a V-belt as in Lane 1 and is driven to have its upper side moving from left to right as shown in FIG. 1. At the right-hand end of the conveyor 18 of Lane 1 is a pair of conveyor feed rollers 28, 30 which are associated with orienting conveyor belts 32, 34 (see FIG. 5A).

As will be described hereinafter, feeder conveyor 18 may take various shapes, depending upon the items to be ironed and the desired eventual folded shape of the items. As shown, each of the plural station feeders, indicated generally by 24, is independently operable and may be on line individually, independent of the other feeders and of the ironer, indicated generally as 26.

Completing the description of the overall system generally depicted in FIG. 1, an inlet conveyor 25 is shown adjacent inlet folders 27A and 27B, and an outlet conveyor 29 is shown at the right-hand end of the ironer 26 for transporting ironed laundry articles out of the ironer for stacking or, in the case of Lane 1, to a further folder 30 for a final folding operation of goods in Lane 1.

The articles, after being draped by the operators, are smoothed, aligned and brushed, as will be described hereinbelow by reference particularly to FIGS. 2-4, and then reoriented horizontally for ironing. This is effected by the article exiting feeder conveyor 18 at orienting conveyor feed rollers 28 and 30, as shown in FIGS. 5A-5B. Roller 28 positions lower orienting belt 32 and second roller 30 positions upper orienting belt 34. Belts 32 and 34 are twisted through a 90° angle and thus the articles exit each feeder 24 horizontally adjacent upper orienting belt exit roller 36 and a lower orienting belt exit roller 98. The articles are thus horizontally fed into ironer 26 at first ironer roller 38 by feed rollers 40. In this manner, the articles are serially fed to plural operators, each of which functions independently, are automatically vertically folded in half, reoriented horizontally or parallel to the axis of the ironer roller and fed to the ironer in one continuous operation wherein each feed unit may be independently operated.

Figure 2:
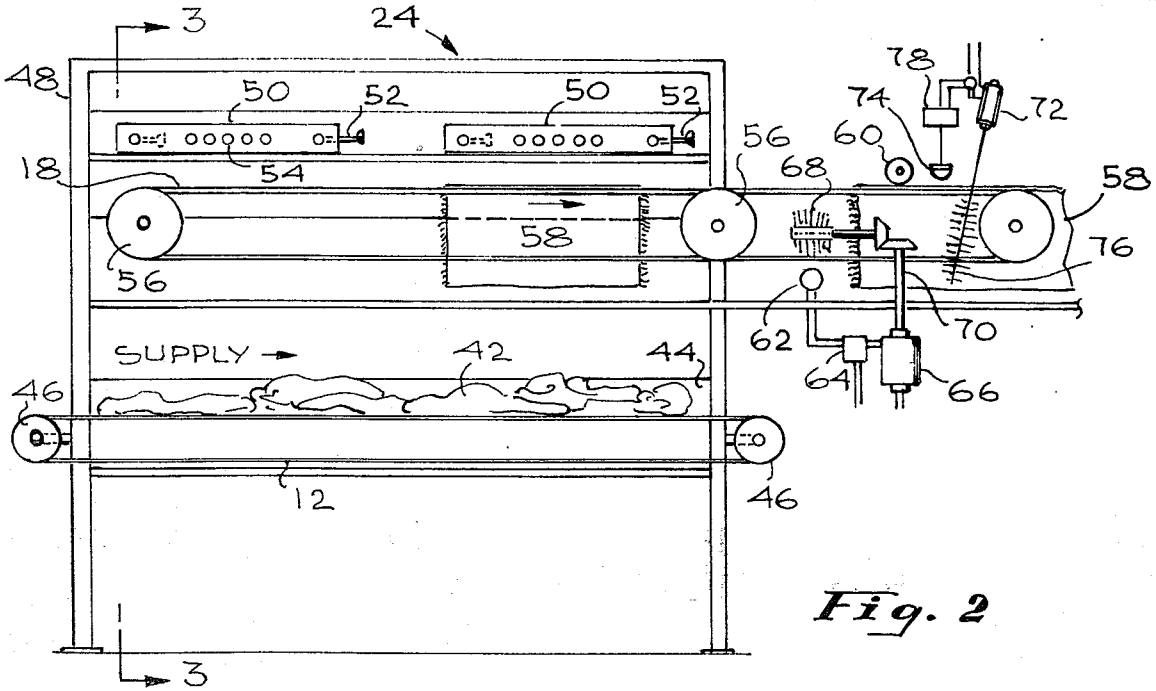
FIG. 2 is a side elevational view of one of the feeder units.

FIG. 2 shows the details of another particular arrangement in accordance with the invention in which a supply conveyor 10 is substantially aligned with the feeder conveyor 18 and in which two operator positions are provided side-by-side. In FIG. 2, articles 42 are provided for the operators, not shown, by supply conveyor 12 which is provided with side supports 44 and positioned by rollers 46, one of which is driven by a motor, not shown. The feeder 24 comprises a frame used to support supply conveyor 12 and to mount touch bars 50. Each operator is provided with a touch bar and each bar is adjustable through pivoting mounting brackets 52 and an adjustable retainer, shown in FIG. 4, which is selectively positioned in one of orifices 54 in the touch bar. In this manner, the operator obtains an article 42 from supply conveyor 12, holding it at its corners, reaches over feeder conveyor 18, which is positioned by rollers 56, to touch the bar 50 and releases the article. A towel 58 is shown in position after release, in FIG. 2, draped over feeder conveyor 18. Feeder conveyor rollers 56 are driven by an electric motor, not shown. Towel 58 is then carried by feeder conveyor 18 in the direction indicated by the arrow to nip roller 60 which is used to hold it in position after it has passed selectively positionable electric eye 62, which is connected to switch 64. Electric eye 62 is positioned between the two portions of the towel, below the level of roller 56, and senses the distance towel 58 hangs downward to determine appropriate alignment. If the towel has been improperly draped, switch 64 initiates operation of electric motor 66 which drives brush 68 through shaft and gear arrangement 70. Nip roller 60 is used to hold the towel in a steady position after this vertical alignment.

The article or towel then passes under second electric eye 74, which senses the presence of the towel and initiates rotation of brush 76 which is rotated by electric motor 72, operated through switch 78 which is interconnected with electric eye 74. As shown, brush 76 rotates in a counterclockwise direction, looking downward, and smoothes towel 58 for entry into the reorienting apparatus depicted in FIGS. 5A and 5B. Electric eye 74 is positioned to stop rotation of brush 76 just prior to the end of towel 58 so that the brush does not catch on the fringe on the towel.

Figure 3:
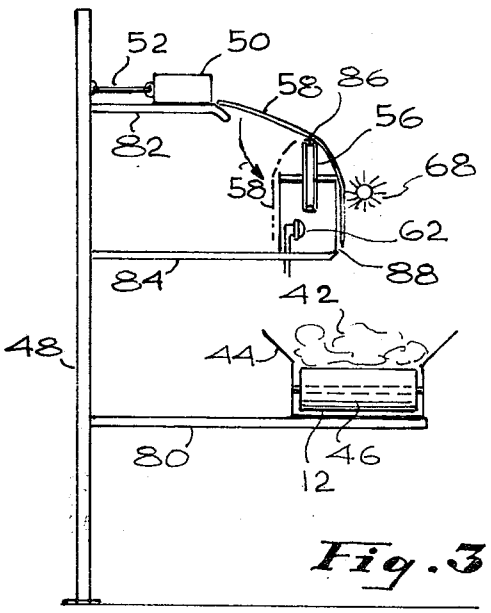
FIG. 3 is a section taken along line 3—3 of FIG. 2, showing one embodiment.

As shown in FIG. 3, a section taken along lines 3—3 of FIG. 2, support bracket 48 is provided with supply conveyor support 80, touch bar support 82 and feeder conveyor support 84. The feeder conveyor embodiment depicted in FIG. 3 is the single inverted V-belt utilizing a narrow belt 86 and wheel 56 on support 88. The arrangement of brush 68 and electric eye 62 is depicted herein as well. V-belt support 88 also provides the requisite draping for towel 58 which is shown in position just prior to release by the operator at touch bar 50, and, in phantom, after release and appropriate draping over support 88 and the belt 86.

Figure 4:
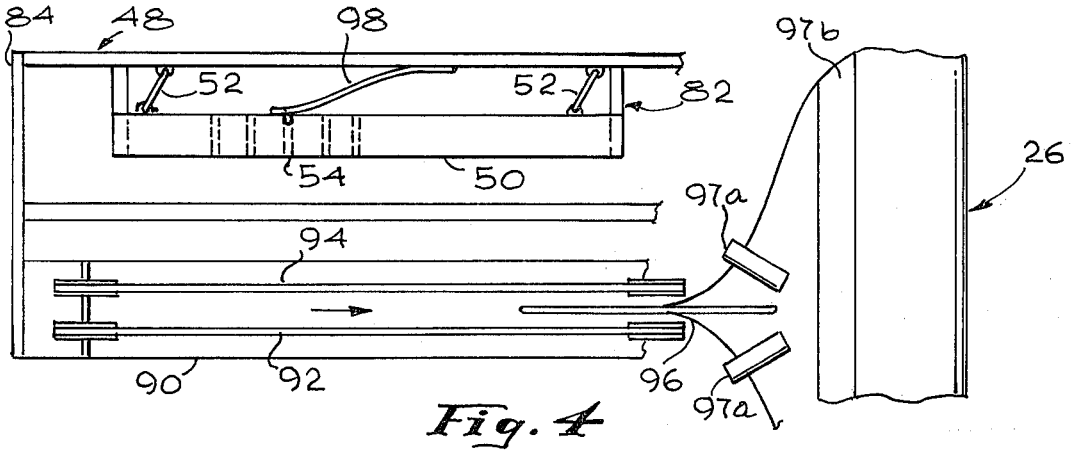
FIG. 4 is a schematic plan view of one feeder showing a second embodiment.
Figure 5A:
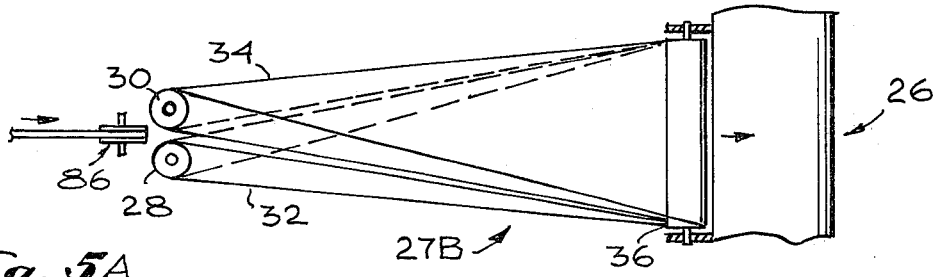
FIGS. 5A and 5B are top and side views, respectively, of a reorientation portion of the apparatus of FIG. 1.
Figure 5B:
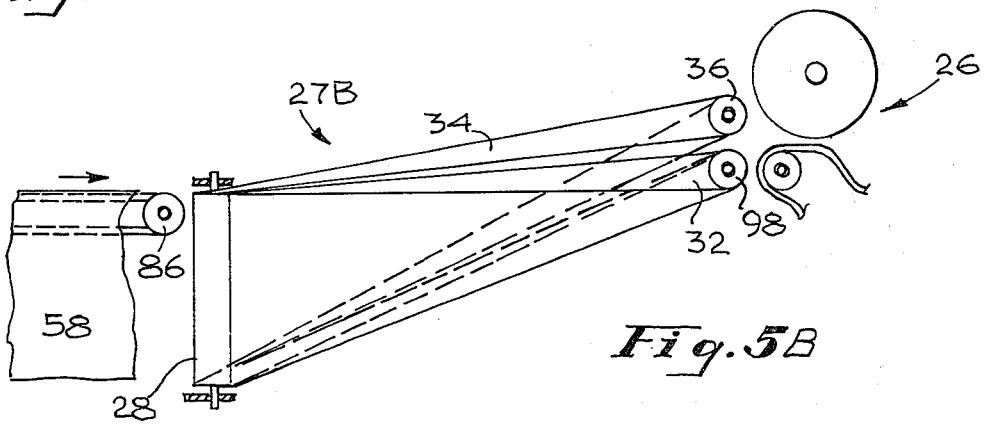

In FIG. 4, a plan view corresponding to FIG. 3 but illustrating a slightly different embodiment, dual conveyor belts 92, 94 are shown. In this figure, support bracket 48 is provided with support member 84, to which is connected the conveyor belt support base 90 mounting the first and second V-belts 92 and 94 for transporting articles draped over them by the operator. In this form, articles of a larger size may be appropriately draped for folding in half prior to ironing or, alternatively, a blade member 96 mounted between the two V-belts 92, 94 may be used to spread openly articles draped over the belts 92, 94 for admission to the ironer in an open, flat horizontal orientation. As the article passes over the member 96 it is picked up by rollers 97*a*, 97*b* and fed into the ironer 26.

Additionally, in FIG. 4, touch bar 50 rests on support 82 and is adjustable through pivot arms 52. The touch bar is retained in position by adjustable retainer 98 being placed in a mating relationship with one of orifices 54 to select the distance that touch bar 50 extends away from support 48, and the reach needed by the operator prior to release of the article.

Optional reorientation portion of the apparatus of the present invention is further depicted in FIGS. 5A and 5B. In these figures, single V-belt on roller 86 supplies articles to upper orienting belt 34 and lower orienting belt 32. The belts are positioned about rollers 28 and 30 so that the towel enters between the upper and lower belts and is grasped firmly along the totality of its folded width. Belts 32 and 34 are retained in a close relationship and twisted to a horizontal or co-planar relationship with ironer 26 at the exit from the reorienter, which is formed by exit rollers 36 and 98. Thus, by the apparatus of the present invention, gravity is utilized to position the towel both easily and rapidly in a half-folded position. The towel is then adjusted to insure accurate ironing, smoothed, and rotated from a vertical orientation to a horizontal orientation for initial folding by folder 27B and ironing in ironer 26. This transverse feed, in combination with the touch bar and the remaining apparatus of the present invention, provides a significant improvement in speed and quality of ironing work. The resulting system allows for plural independent feeds to an ironer, plural stations for each train and simple easy accurate operation of an ironing system.

Figure 6A:
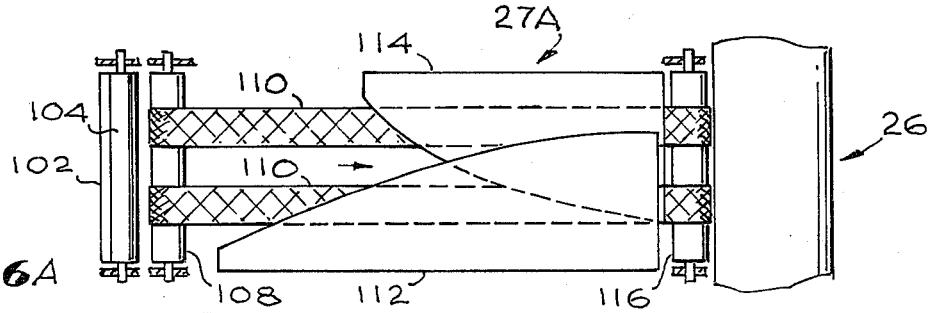
FIGS. 6A and 6B are top and side views, respectively, of a french folder which may be used with the system of the invention.
Figure 6B:
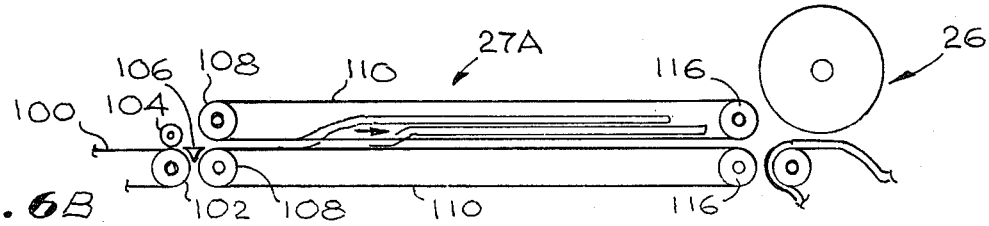

In an alternative embodiment depicted in FIGS. 6A and 6B, a french folder such as 27A of FIG. 1 is used in place of or with the reorientation apparatus. In this apparatus, woven belting is utilized for the feed conveyor, and the articles are positioned by the use of a touch bar as in the prior systems. However, in this operation, feed conveyor 100 terminates at roller 102 and the article is positively fed to the french folder through nip roller 104 and guide 106. The french folder 27A is preferably formed of elongated rollers 108 which are provided with plural gripping conveyors 110 to grasp the article and convey it toward ironer 26. As the article is conveyed toward ironer 106, it comes in contact with first guide 112 which initiates folding of one side of the article by curling it over on itself. After this is initiated, the opposite side of the article is folded over by second french folder guide 114. The article then exits the french folding section between rollers 116 which are rotated by conveyors 110 and enters ironer 26. In this manner, the plural station feeders of the present invention may be utilized to french fold articles prior to ironing.

Although there have been described above specific arrangements of a multi-station feeder for a commercial ironer or folder in accordance with the invention for the purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A multi-station feeder for articles comprising:

article supply means;

plural stations for receiving articles from said supply means, each station including an operator position;

article feed means adjacent each station including conveyor means extending alongside the associated operator positions and adapted to carry articles positioned thereon, the plural stations being arranged in separate lanes, side by side, each lane including at least two operator stations serially positioned side by side along individual article supply means and article conveyor means common to that lane, the arrangement being adapted to permit operators at the side-by-side stations to select articles from the common supply means and place them on the adjacent conveyor means without interference between the stations;

touch bar means for each station selectively positionable in accordance with article size, the touch bar means being located on a side of the conveyor means remote from the station operator position; and article exit means, whereby articles are supplied to each station by said supply means, selected by an operator, placed on said conveyor means by the operator extending the article across the conveyor means to contact the touch bar means and thereafter dropping the article over the conveyor means in a centrally folded configuration in a position determined by said touch bar means, and thereafter conveyed to said exit means.

2. The apparatus of claim 1 wherein said conveyor means comprises a single V-belt.

3. The apparatus of claim 2 wherein said touch bar means include a touch bar positioned to provide that the articles are draped equally on either side of the V-belt.

4. The apparatus of claim 3 further comprising article reorienting means associated with said exit means and adapted to reorient said articles from a vertical to a horizontal attitude.

5. The apparatus of claim 4 wherein said reorienting means includes a pair of side-by-side belts adapted to convey said article therebetween, the inlet to said belts being vertically oriented and the exit to said belts being horizontally oriented.

6. The apparatus of claim 5 further comprising adjusting means effective to equalize the amount of an article on either side of the V-belt.

7. The apparatus of claim 6 further comprising an electric eye selectively positionable to sense the presence or absence of an article a preselected distance away from said V-belt and coupled with brush means effective to reposition an article in response to a signal received from said electric eye.

8. The apparatus of claim 1 wherein said conveyor means comprises a pair of spaced-apart V-belts.

9. The apparatus of claim 8 further comprising article locating means positioned between said feed belts and adapted to reorient the articles exiting said feeder.

10. The apparatus of claim 9 comprising article reorienting means attached to said exit means and adapted to reorient said articles from vertical to horizontal.

11. The apparatus of claim 10 wherein said reorienting means includes a pair of laterally curved belts adapted to convey said article therebetween, the inlet to said curved belts being vertically oriented and the exit to said curved belts being horizontally oriented.

12. The apparatus of claim 1 further comprising brush means selectively operable during the passage of an article along said conveyor means and effective to smooth said article along said conveyor means.

13. The apparatus of claim 12 further comprising sensor means effective to terminate operation of said brush prior to contact between the trailing edge of an article and said brush.

14. The apparatus of claim 13 further comprising two opposed pairs of belts adapted to hold and convey an article being french folded, and first and second guide means adapted to fold over the outer portions of an article being french folded.

15. The apparatus of claim 1 further comprising french folding means associated with said article exit means in said feeder, effective to receive articles from said feeder, french fold said articles, and further convey said articles.

16. The apparatus of claim 1 wherein at least two of the plural stations are positioned in sequence along the same article feed means for enabling the placement of articles from a common article supply means to the same conveyor means.

17. A multiple line feeder system for laundry articles which is adapted to provide multiple feed lanes to an ironer, each feed lane comprising:

article supply means;

a plurality of operator stations positioned side by side in sequence along the article supply means, each station including an operator position;

common article feed means adjacent each station including common conveyor means extending alongside the side-by-side operator stations and adapted to carry articles positioned thereon, the arrangement being adapted to permit operators at the side-by-side stations to select articles from the article supply means and place them on the adjacent conveyor means without interference between the stations;

touch bar means for each station selectively positionable in accordance with article size, the touch bar means being located on a side of the conveyor means remote from the station operator position; and article exit means, whereby articles are supplied to each station by said supply means, selected by the operators, placed on said conveyor means by the operators extending the articles across the conveyor means to contact the touch bar means and thereafter dropping the articles over the conveyor means in a centrally folded configuration in positions determined by said touch bar means.

18. The apparatus of claim 17 wherein said conveyor means comprises a single V-belt.

19. The apparatus of claim 18 wherein said touch bar means includes a touch bar positioned so that the articles are draped equally on either side of the V-belt.

20. The apparatus of claim 19 further comprising article reorienting means associated with said exit means and adapted to reorient said articles from vertical to horizontal.

21. The apparatus of claim 20 wherein said reorienting means includes a pair of belt means adapted to convey said article therebetween, the inlet to said belt means being vertically oriented and the exit to said belt means being horizontally oriented.

22. The apparatus of claim 21 further comprising adjusting means effective to equalize the amount of an article on either side of said feed belt.

23. The apparatus of claim 22 further comprising an electric eye selectively positionable to sense the presence of an article a preselected distance away from said V-belt and coupled with brush means effective to reposition an article in response to a signal received from said electric eye.

24. The apparatus of claim 17 wherein said conveyor means comprises a pair of spaced-apart V-belts.

25. The apparatus of claim 24 further comprising article reorienting means attached to said exit means and adapted to reorient said articles from vertical to horizontal.

26. The apparatus of claim 25 wherein said reorienting means includes a pair of belt means adapted to convey said article therebetween, the inlet to said belt means being vertically oriented and the exit to said belt means being horizontally oriented.

27. The apparatus of claim 26 further comprising brush means selectively operable during the passage of an article along said conveyor means and effective to smooth said article along said conveyor means.

28. The apparatus of claim 17 comprising at least two feed lanes, each feed lane including two operator stations and a folder positioned at the outlet of the common conveyor means for prefolding laundry articles before passing the articles to the ironer.

* * * * *